US006249301B1

(12) United States Patent
Kawamura et al.

(10) Patent No.: US 6,249,301 B1
(45) Date of Patent: Jun. 19, 2001

(54) SUBLIMATION TYPE COLOR PRINTER

(75) Inventors: Shigeyuki Kawamura; Minoru Yamakuni, both of Ise (JP)

(73) Assignee: Shinko Electric Co., Ltd., Tokyo (JP)

( * ) Notice: Subject to any disclaimer, the term of this patent is extended or adjusted under 35 U.S.C. 154(b) by 0 days.

(21) Appl. No.: 09/670,946

(22) Filed: Sep. 27, 2000

(30) Foreign Application Priority Data

Sep. 27, 1999 (JP) ..... 11-273456

(51) Int. Cl.[7] ..... B41J 15/04; B41J 11/42; B41J 11/70

(52) U.S. Cl. ..... 347/218; 347/176

(58) Field of Search ..... 347/172, 174, 347/176, 222, 218; 400/621, 614, 617

(56) References Cited

U.S. PATENT DOCUMENTS 5,201,588 * 4/1993 Sakai et al. ..... 347/222

FOREIGN PATENT DOCUMENTS 63-303779 * 12/1988 (JP) .
4-246575 * 9/1992 (JP) .
5-147280 * 6/1993 (JP) .
6-336063 * 12/1994 (JP) .
10-138582 * 5/1998 (JP) .

* cited by examiner

*Primary Examiner*—Huan Tran
(74) *Attorney, Agent, or Firm*—Scully, Scott, Murphy & Presser

(57) ABSTRACT

The present invention relates a sublimation type color printer for printing a paper 11 pulled out from a roll of the paper, cutting the paper to a predetermined length, and outputting the printed paper; wherein the roll is installed into a cassette 22. The printer comprises a paper transfer means composed of a pair of transfer rollers 23 and the like which can transfer a leading edge of the paper along the front and rear directions between a print stand-by position at the outside of the cassette and a stand-by position in the cassette at the inside of the cassette. Because of this sublimation type color printer, a high-quality picture can be provided at low running cost.

7 Claims, 5 Drawing Sheets

PRIOR ART

SUBLIMATION TYPE COLOR PRINTER

BACKGROUND OF THE INVENTION

1. Field of the Invention

The present invention relates to a sublimation type color printer used for an output device for a digital photograph. This application is based on Japanese Patent Application No. Hei 11-273456, the contents of which are incorporated herein by reference.

2. Description of the Related Art

Recently, an output device which can prints a high-quality picture at low-cost is required due to the popularization of the digital camera. In response to this requirement, there is a sublimation type (heat transcription type) color printer which prints a picture on a paper pulled out from a roll of the paper. The adoption of the rolled paper is moreadvantageous than a pre-cut paper in terms of costs.

FIG. 6 shows a structure of a conventional sublimation type color printer. In this figure, reference number 1 denotes a paper, reference number 2 denotes a roll of the paper 1, reference number 3 denotes a platen, reference number 4 denotes a pair of first transfer rollers, reference number 5 denotes a pair of second transfer rollers, reference number 6 denotes a cutter, reference number 7 denotes a paper guide, reference number 8 denotes a thermal head, reference number 9 denotes an ink ribbon, and reference number 10 denotes a paper outlet.

In this sublimation type color printer, an operator sets the roll 2 at the predetermined position, and pulls the leading edge of the paper 1 from the roll 2 and manually inserts the tip between the first transfer rollers 4, in preparation for the operation. Next, the operator gives a paper induction command by operating a switch button (omitted in the Figure) for example, then, an initial operations such as cutting the leading edge of the paper 1 are done, and the tip is finally guided to a print stand-by position PS in FIG. 7. At this print stand-by position PS, the leading edge of the paper 1 projects slightly from the first transfer rollers 4 in the direction of the second transfer rollers 5.

Further, as a result of giving a print command at the print stand-by position PS shown in FIG. 7, a print operation is carried out and the paper 1 reciprocates within a predetermined printing area. In the normal color print, the printed colors are expressed by stacking the layers of three colors: yellow (Y), magenta (M), and cyan (C), on the paper 1, and an overcoat layer covers these layers for preventing the fading of the colors. Therefore, in the case of the conventional printer as shown in the Figure, the paper 1 reciprocates four times within the printing area, and the printing by the each ink ribbon which corresponds to the each color of Y, M, and C, and the coating of the overcoat layer are successively carried out.

The print operation for a piece of paper is finished in the above-described manner, and then, the paper 1 is cut by the cutter 6 to the predetermined length and ejected from the outlet 10. In addition, when a series of the above-described work for printing is finished, the leading edge of the paper 1 is returned to the print stand-by position PS in FIG. 7.

In the sublimation type color printer, when dust and the like lie on the paper, or the paper is folded, inks are not transferred on this part and an insufficient transfer occurs. Such an insufficient transfer reduces the commercial value of the output device for the digital camera in which a high-quality picture is required.

Furthermore, in addition to the quality requirements of the picture, the reduction of the running cost is also required for the widespread adoption of the pictures by the sublimation type color printer instead of photographs using silver-salt.

However, in the conventional sublimation type color printer as described above, the paper 1 at the print stand-by position PS is prepared away from the roll 2, and therefore, dust can easily accumulate on the paper 1. Furthermore, the paper 1 at the print stand-by position PS is prepared in a holding manner by the guides 7 and the first transfer rollers 4 which locate the upper and lower sides of the paper 1, and therefore, the paper 1 can easily become folded.

In addition, the dust which attaches to the paper 1 at the production of the paper 1, the dust which exist in the printer and lies on the surface of the paper 1, and cellulose which exist in the paper 1 and lies on the surface of the paper 1, are thought to be the source of the dust which causes the insufficient transfer However, it is difficult to remove this dust completely.

The present invention is provided in consideration of the above circumstances, and purposes of the present invention are to provide a sublimation type color printer which can provide a high-quality picture with low running cost.

SUMMARY OF THE INVENTION

In the present invention, to solve the above-described problems, the following measures are adopted.

The present invention relates a sublimation type color printer for printing a paper pulled out from a roll of the paper, cutting the paper to a predetermined length, and outputting the printed paper; wherein the roll is installed into a cassette. The printer comprises a paper transfer means which can transfer a leading edge of the paper along the front and rear directions between a print stand-by position at the outside of the cassette and a stand-by position inside the cassette.

In this case, it is preferable that the tip reverts to the stand-by position in the cassette for stand-by when no print command is received during a predetermined time.

It is further preferable that the tip is transferred to the print stand-by position when the tip is located in the stand-by position in the cassette and some operation is done by a host of the printer.

In this sublimation type color printer, the paper is covered in the cassette when no print command is received because the paper transfer means is provided, and therefore, the adhesion of dust and the like to the surface of the paper decreases, and the folding of the paper in the cassette is prevented. Therefore, the cause of the insufficient ink transfer is solved and a high-quality a picture can be provided with low running cost using the rolled paper which is advantageous in cost. Furthermore, the total time for the print operation is not increased because the tip is transferred to the print stand-by position by some operation of the host.

The present invention also relates a sublimation type color printer for printing a paper pulled out from a roll of the paper which is installed in a cassette by reciprocating the paper within a predetermined print area, cutting the paper to a predetermined length by a cutter, and outputting the printed paper. The printer comprising a plurality of dust collection rollers which have adhesive surfaces and provided for attachment to the transference course of the paper between the cassette and the cutter, and respectively provided to a position adjacent to the paper outlet of the cassette and to a position adjacent to the front of the cutter.

In this case, it is preferable that the dust collection rollers are provided at the outlet of the print area.

It is further preferable that at least one of the dust collection rollers has a means for detecting the transference situation of the paper.

In this sublimation type color printer, dust on the paper is removed by the dust collection rollers before the print. Furthermore, the desirable material for the dust collection can be employed for the dust collection rollers without consideration for the reverse transcription toward the dust collection rollers because the dust collection rollers are provided at the outlet of the printing area. In addition, the abnormal transference of the paper is detected and the appropriate measure can be carried out because the means for detecting a transference situation of the paper is provided on the dust collection rollers.

DESCRIPTION OF THE PREFERRED EMBODIMENTS

Embodiments of the sublimation type color printer of the present invention will be explained below with reference to Figures.

Figure 1:
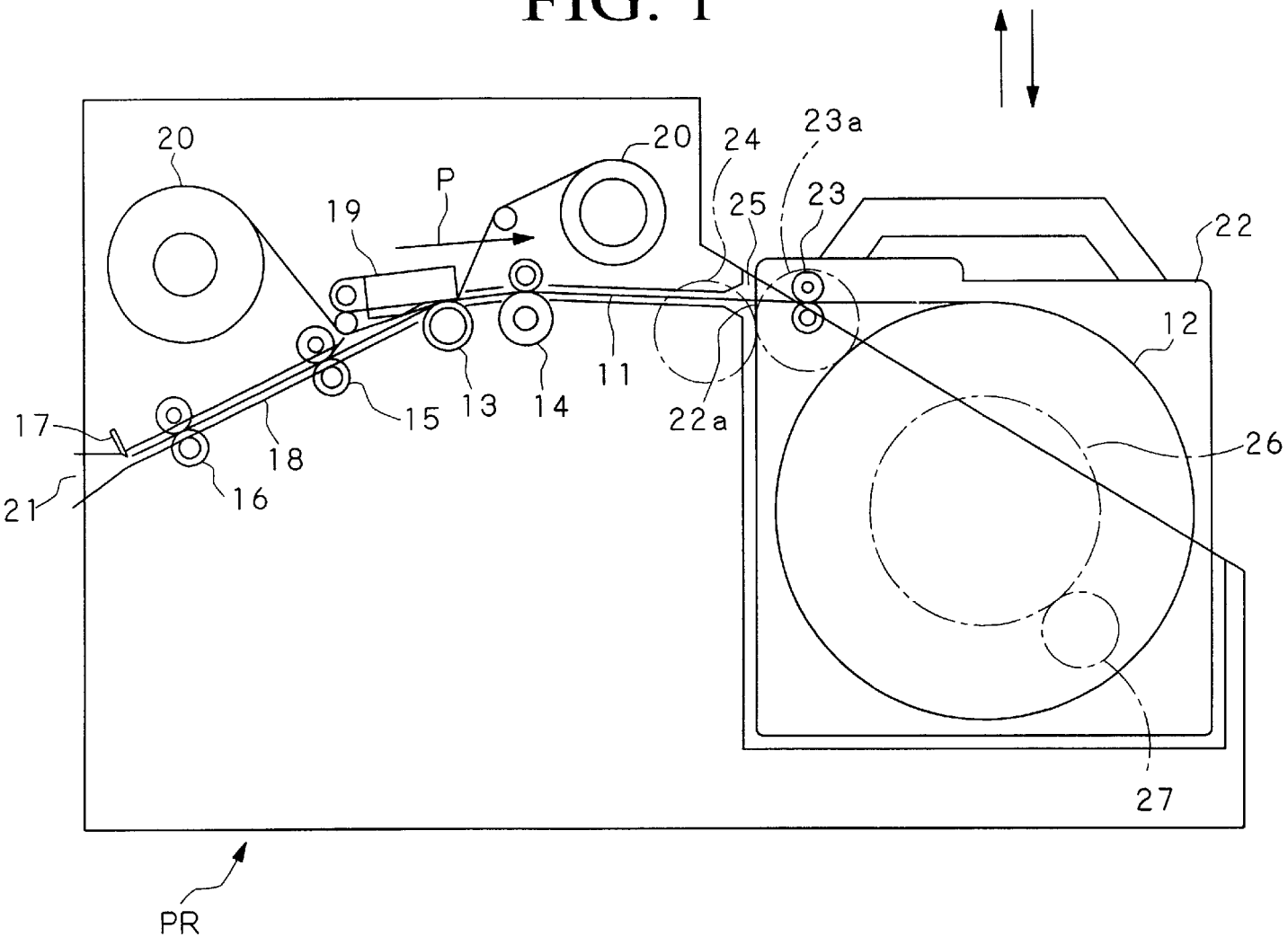
FIG. 1 is a schematic diagram of the first embodiment of the sublimation type color printer of the present invention.

In the first embodiment of the present invention shown in FIG. 1, reference number 11 denotes a paper, reference number 12 denotes a roll of the paper 11, reference number 13 denotes a platen, reference number 14 denotes a pair of first transfer rollers, reference number 15 denotes a pair of second transfer rollers, reference number 16 denotes a pair of third transfer rollers, reference number 17 denotes a cutter, reference number 18 denotes a paper guide, reference number 19 denotes a thermal head, reference number 20 denotes a ink ribbon, and reference number 21 denotes a paper outlet.

In the first embodiment, the roll 12 is composed by the wound paper 11 and inserted into the cassette 22, which is set into a printer main body PR. This cassette 22 is detachable from the printer main body PR, and is installed in the predetermined position of the printer main body PR after the installation of the roll 12 in the predetermined position of the cassette 22.

Furthermore, in the inside of the cassette 22, a pair of paper supply rollers 23 are provided adjacent to a paper outlet 22*a*. The paper supply rollers 23 have a supply roller axial gear 23*a*, which has a same axis as that of one of the paper supply rollers 23. This supply roller axial gear 23*a* engages with a paper supply gear 2,4 which is provided at the side of the printer main body PR, when the cassette 22 is installed in the predetermined position of the printer main body PR. The paper supply gear 24 has a stepping motor which is omitted in the Figure. In addition, the paper outlet 22*a* of the cassette 22 is connected to a paper inlet 25, which is provided at the printer main body PR for guidance of the paper 11 to the paper guide 18.

Meanwhile, in the Figure, reference number 26 denotes a roll gear that is fixed on the axis for supporting the roll 12, and reference number 27 denotes a rewind gear that engages with the roll gear 26. The paper 11 can be transferred in the forward direction in accordance with the transference of the paper 11 to the printer main body PR side by rotating the paper supply rollers 23, which have the same axis as the supply roller axial gear 23*a* that is driven by the paper supply gear 24, and also can be transferred in the backward direction in accordance with the rewind of the paper 11 by rotating the roll 12 simultaneously with the rotation of the roll gear 26, which is driven by the rewind gear 27. As a result, a paper transfer means which can transfer the leading edge of the paper 11 between the "print stand-by position PS" at the outside of the cassette 22 (refer to FIG. 2) and the "stand-by position in the cassette CS" at the inside of the cassette 22 (refer to FIG. 3) as described below is composed. Furthermore, the rewind gear 27 is provided at the printer main body PR side and has a driving source, which is omitted in the Figure. The rewind gear 27 is engaged with the roll gear 26 when the cassette 22 is installed.

The operation of the sublimation type color printer having the above-described structure is explained below.

First, the operator installs the cassette 22 in which the roll 12 is installed and the leading edge of the paper 11 is inserted between the paper supply rollers 23, in the predetermined position of the printer main body PR. Next, the operator pushes a paper sending switch (not shown in Figure), and thereupon, the stepping motor is operated and the paper supply rollers 23 are driven, and the leading edge of the paper 11 is sent to the printer main body PR. The leading edge of the paper 11 is introduced into the paper inlet 25 from the paper outlet 22*a*, and guided to a cutting position which is predetermined at the paper outlet 21 side by the cutter 17, through the paper guide 18, the first transfer rollers 14, the second transfer rollers 15, and the third transfer rollers 16. The leading edge of the paper 11 which is sent to the cutting position is cut by the operation of the cutter 17.

Figure 2:
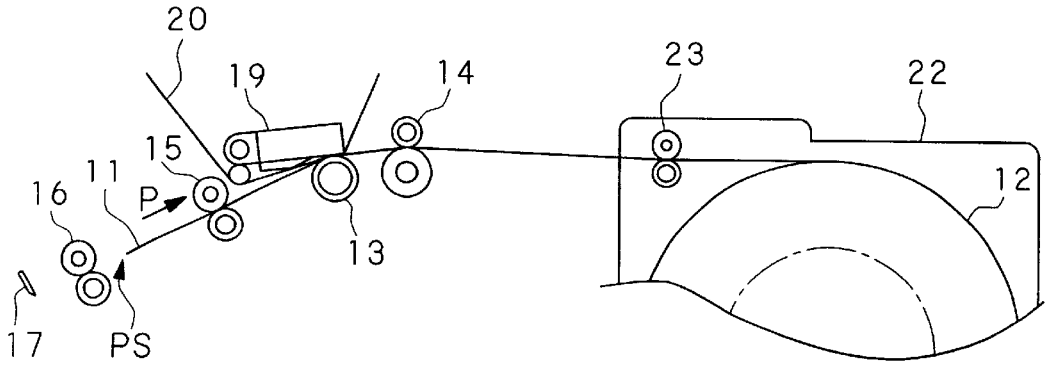
FIG. 2 shows the sublimation type color printer in FIG. 1 at the stage that the leading edge of the paper is located at the print stand-by position.

After that, the paper 11 reverts to the print stand-by position PS, which is located between the second transfer rollers 15 and the third transfer rollers 16 in case of the embodiment of FIG. 2. In this embodiment, the stand-by position PS is determined the above position because the print is preformed by transferring the paper 11 from the stand-by position PS along a printing direction shown in arrow P, and therefore, the print stand-by position PS can be changed in compliance with the printing direction of the printer and the like. In addition, the sagging of the paper 11 is prevented by the paper guide 18, which is omitted in FIG. 2. Normally, the print operation is started from the print stand-by position PS and paper 11 reciprocates four times within a predetermined print area, and the print of the layers of Y, M, and C and the overcoat layer are successively carried out. The printed paper 11 is sent to the paper outlet 21 and cut to the predetermined length by the cutter 17, and is output as a sheet of printed paper. When the cutting by the cutter 17 is finished, the leading edge of the paper 11 reverts to the print stand-by position PS again, and the same motions are repeated in case of the print operation is continued. Furthermore, the print operation for the predetermined number of paper is finished, the leading edge of the paper 11 is reversed to the print stand-by position PS and is on stand-by during the predetermined time.

Figure 3:
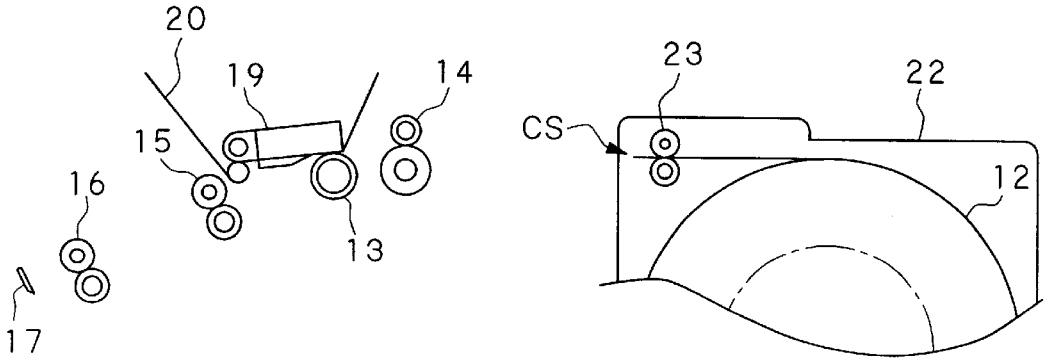
FIG. 3 shows the sublimation type color printer in FIG. 1 at the stage that the leading edge of the paper is located at the stand-by position in the cassette.

When the above-described waiting time at the print stand-by position PS exceeds a predetermined time, that is, there is no further print command during a predetermined time, the leading edge of the paper 11 reverts to the stand-by position in the cassette CS in FIG. 3. At this time, the roll gear 26, which is driven by the rewind gear 27, rotates to rewind the paper 11 around the roll 12 until the leading edge of the paper 11 is located adjacent to the paper supply rollers 23 in the cassette 22, and the paper 11 is on stand-by at this position. As a result, the waiting time of the paper 11 at the printing area (transference course), which is located outside of the cassette 22, does not exceed the predetermined time, and therefore, the capability of adhesion of dust on the surface of the paper 11 is decreases greatly in comparison to the conventional printer.

Furthermore, the paper 11 in the stand-by position in the cassette CS has no folding part such as the part which is attached the platen 13 at the print stand-by position PS, and therefore, there is no worry that the paper 11 will be folded at the stand-by position in the cassette CS.

Next, the operation in the case that the printer receives the print command when the leading edge of the paper 11 is located on the stand-by position in the cassette CS is explained below. This print command is normally is outputted by a host (a personal computer and the like) in which the sublimation type color printer is connected. Therefore, in this case, by starting the operation that transfers the leading edge of the paper 11 in the stand-by position in the cassette CS to the print stand-by position PS simultaneously to the starting of the operation of the key or touch-panel of the host, the operation for transference is finished before the processing of the host is finished.

According to this procedure, the paper 11 is already on stand-by in the print stand-by position PS when the print command has been received, and the print operation can be started immediately. Hence, even the leading edge of the paper 11 is hidden in the stand-by position in the cassette CS for preventing the attachment of dust, the time for transference of the tip to the print stand-by position PS is saved, and the total time for the print operation is not increased.

Figure 4:
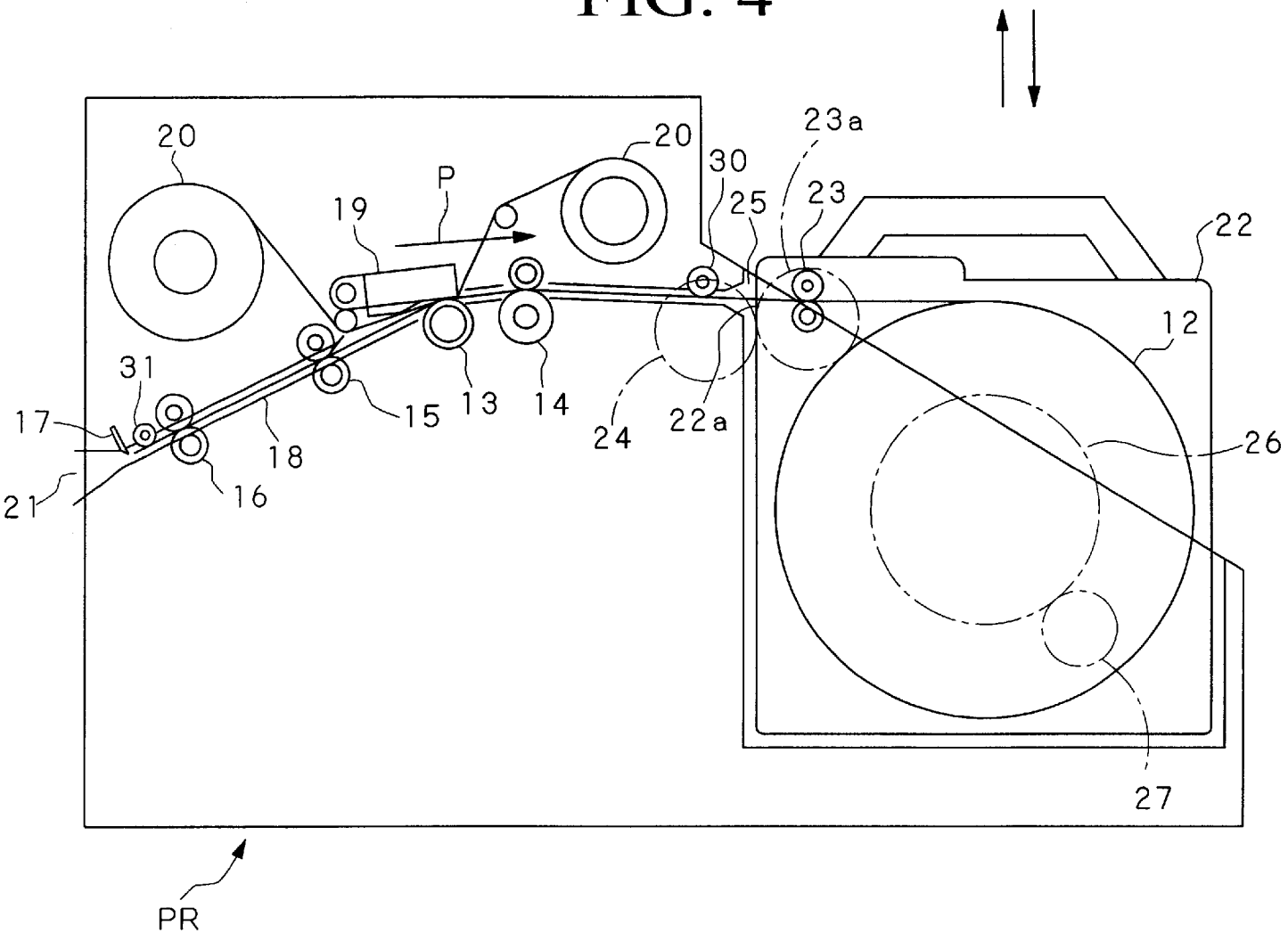
FIG. 4 is a schematic diagram of the second embodiment of the sublimation type color printer of the present invention.

Next, a second embodiment of the present invention will be explained with FIG. 4.

In this embodiment, dust collection rollers 30, 31 have adhesive surfaces that are provided so as to attach the surface of the paper 11 which is subjected to print, at the transference course between the cassette 22 and the cutter 17. This dust collection rollers 30, 31 are driven by the transferred paper 11 which is attached to the adhesive surfaces of the dust collection rollers 30, 31, and adhesive rubber rollers are preferably used as the dust collection rollers 30, 31.

However, when the dust collection rollers 30, 31 are provided in the printing area in which the paper 11 is reciprocally transferred during the print operation, the sublimation dyestuffs that are printed on the paper 11 are transcribed in reverse with respect to the dust collection rollers 30, 31. Normally, a material that does not react to the sublimation dyestuffs, such as a fluoro plastic, is used for the material of rollers located in the print area for preventing this reverse transcription. However, it is difficult to employ the material for the dust collection rollers in which the adhesiveness is required.

Accordingly, in the present invention, the dust collection rollers 30, 31 are provided at the outlet of the printing area. That is, the one dust collection roller 30 is provided adjacent to the paper outlet 22*a* of the cassette 22 so as to mainly remove the dust on the surface of the paper 11 which is sent out from the cassette 22, and the other dust collection roller 31 is provided adjacent to the front of the cutter 17 so as to mainly remove the dust produced by the cutting of the paper 11.

As described above, a suitable material for the dust collection can be employed for the dust collection rollers 30, 31 without consideration of the measure to the reverse transcription toward the dust collection rollers 30, 31 because the dust collection rollers 30, 31 are provided at the outlet of the printing area. In addition, the other dust collection roller 31, which is provided at the front side of the cutter 17, is attached to the printed surface of the paper 11, however, the reverse transcription does not occur because the overcoat layer covers the printed surface.

Meanwhile, as described above, the roll of the dust collection rollers 30, 31 is driven by the friction between the dust collection rollers 30, 31 and the paper 11. However, the paper 11 has no end edge because the paper 11 is continuously supplied, and therefore, the inconvenience that the position of the paper 11 in the printer main body PR cannot be accurately grasped may occur. The inconvenience occurs by the error of the stepping motor and the like for transference or the slack of the paper 11, for example.

Figure 5A:
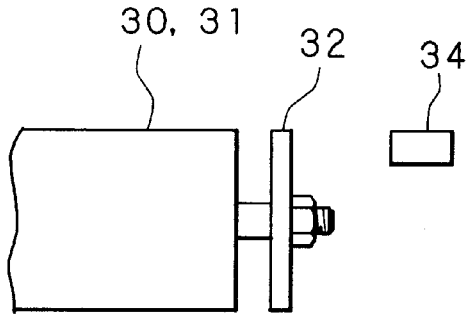
FIG. 5A is a side view of the embodiment of the detecting means for detecting the moving state of the paper.
Figure 5B:
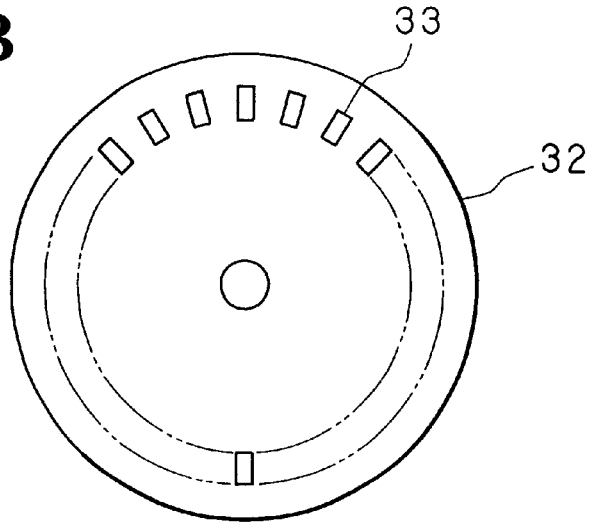
FIG. 5B is a front view of the disc of the detecting means.
Figure 6:
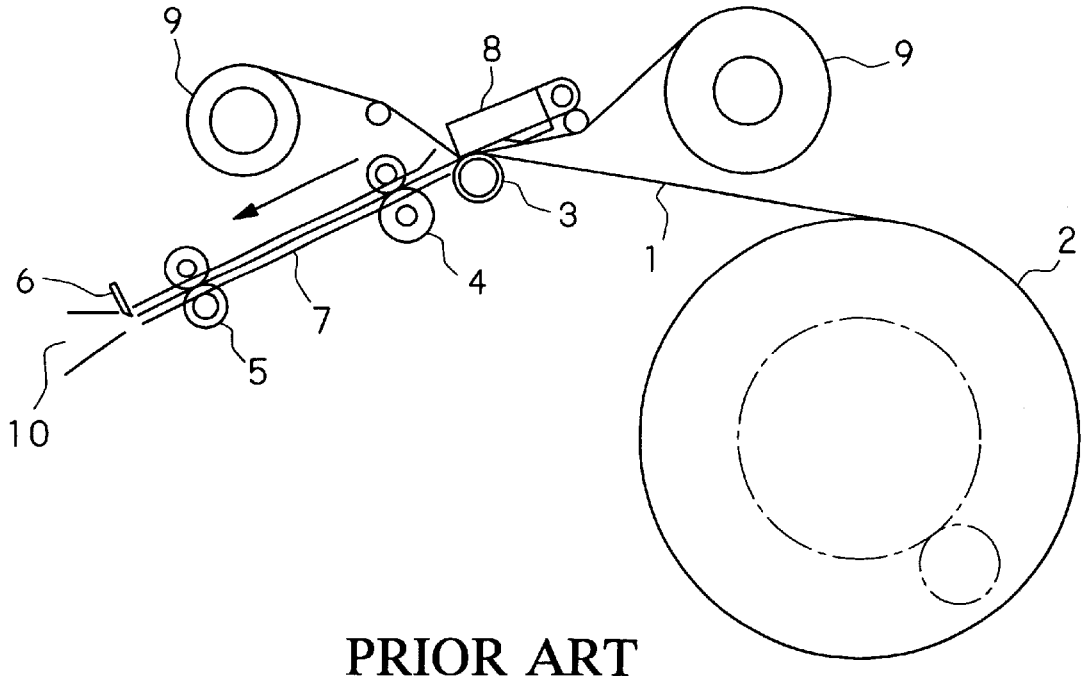
FIG. 6 is a schematic diagram of the conventional sublimation type color printer.
Figure 7:
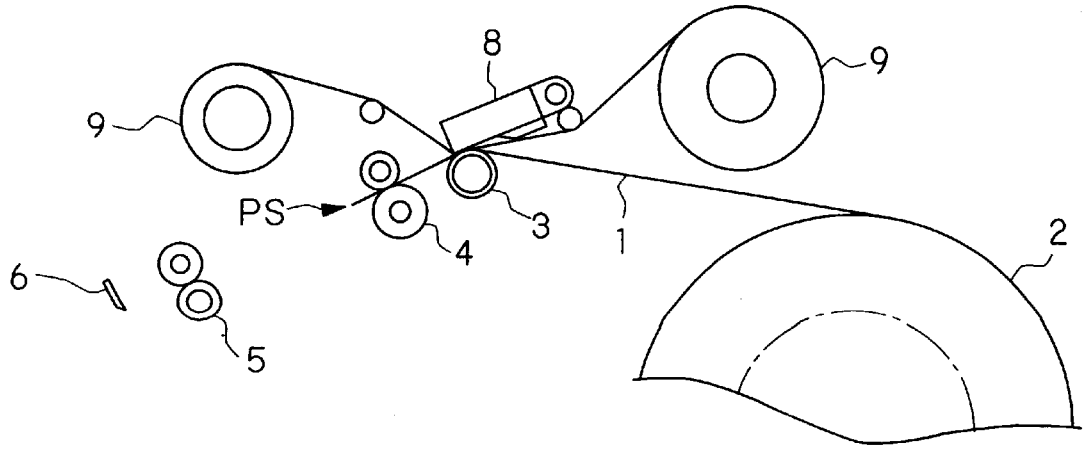
PRIOR ART FIG. 7
FIG. 7 shows the sublimation type color printer in FIG. 6 at the stage that the leading edge of the paper is located at the print stand-by position.

This inconvenience can be solved by detecting the abnormal transference of the transference paper 11 by measuring the rotation speed of the dust collection rollers 30, 31. That is, a disc 32 which is installed on the dust collection rollers 30, 31 so as to have a same axis as shown in FIGS. 5A, 5B, and measuring the rotation speed of the dust collection rollers 30, 3 from that of the disc 32. The rotation speed of the disc 32 is measured by detecting a plurality of slits 33 which are formed on the disc 32 with the same pitch along the circumference of the disc 32, by using a photo sensor 34 and calculating the rotation speed from the detected pulse signals. The rotation speed can also be measured by detecting the reflection mark which is printed in black and white and attached the surface of disc 32 instead of the slits, by the photo sensor 34.

According to the measurement of the rotation speed of the dust collection rollers 30, 31 by the method as disclosed above, when the abnormal rotation of the dust collection rollers 30, 31 corresponding to the abnormal transference of the paper 11 occurs, the presence of the abnormal transference can easily be detected, and therefore, the measure such as an emergency stop can be done as required by necessity.

In addition, the dust collection rollers 30, 31 may be detachably installed on the printer. In this case, the dust collection rollers 30, 31 can easily be cleaned in order to remove the dust and the like which adheres on the dust collection rollers 30, 31, by removing the dust collection rollers 30, 31.

What is claimed is:

1. A sublimation type color printer for printing a paper pulled out from a roll of the paper, cutting the paper to a predetermined length, and outputting the printed paper; wherein the roll is installed into a cassette, and the printer comprises:

a paper transfer means which can transfer a tip of said paper along the forward and backward directions between a print stand-by position at the outside of said cassette and a stand-by position inside the cassette.

2. A sublimation type color printer according to claim 1, wherein said tip is reverts to said stand-by position in the cassette f or stand-by when no print command is received during the predetermined time.

3. A sublimation type color printer according to claim 2, wherein said tip is transferred to said print stand-by position when said tip is located in the stand-by position in the cassette and some operation is done by a host of the printer.

4. A sublimation type color printer for printing a paper pulled out from a roll of the paper which is installed into a cassette by reciprocating said paper within a predetermined print area, cutting the paper to a predetermined length by a cutter, and outputting the printed paper, comprises:

a plurality of dust collection rollers which have adhesive surfaces provided to attach the transference course of said paper between said cassette and said cutter, and respectively provided at a position adjacent to the paper outlet of said cassette and to a position adjacent to the front of said cutter.

5. A sublimation type color printer according to claim 4, wherein said dust collection rollers are provided at the outlet of said print area.

6. A sublimation type color printer according to claim 4, wherein at least one of said dust collection rollers having a means for detecting a transference situation of said paper.

7. A sublimation type color printer according to claim 5, wherein at least one of said dust collection rollers having a means for detecting a transference situation of said paper.

* * * * *